US006389663B1

(12) United States Patent
Milanese et al.

(10) Patent No.: US 6,389,663 B1
(45) Date of Patent: May 21, 2002

(54) STRETCHER FOR TUBULAR FABRIC WITH MAGNETIC ATTRACTION

(75) Inventors: Renzo Milanese, Marano Ticino; Giancarlo Ferraro, Somma Lombardo, both of (IT)

(73) Assignee: Ferraro S.p.A., Lonato Pozzolo (IT)

( * ) Notice: Subject to any disclaimer, the term of this patent is extended or adjusted under 35 U.S.C. 154(b) by 0 days.

(21) Appl. No.: 09/830,662

(22) PCT Filed: Oct. 28, 1999

(86) PCT No.: PCT/IT99/00344

§ 371 Date: Apr. 26, 2001

§ 102(e) Date: Apr. 26, 2001

(87) PCT Pub. No.: WO00/26459

PCT Pub. Date: May 11, 2000

(30) Foreign Application Priority Data

Nov. 4, 1998 (IT) ..... MI98A2373

(51) Int. Cl.[7] ..... D06C 5/00

(52) U.S. Cl. ..... 26/80; 26/83

(58) Field of Search ..... 26/80, 82, 83, 26/84, 85, 87, 97, 98

(56) References Cited

U.S. PATENT DOCUMENTS

| | | | | | |
|---|---|---|---|---|---|
| 2,507,599 | A | * | 5/1950 | Johnson | 26/84 |
| 2,517,067 | A | * | 8/1950 | Wedler | 26/80 |
| 2,623,263 | A | * | 12/1952 | Dungler | 26/84 |
| 2,623,264 | A | * | 12/1952 | Dungler | 26/80 |
| 3,175,272 | A | * | 3/1965 | Cohn et al. | 26/84 |
| 3,955,251 | A | * | 5/1976 | Hogendyk | 26/80 |
| 3,978,557 | A | * | 9/1976 | Goodson | 26/84 |
| 4,103,402 | A | * | 8/1978 | Frezza | 26/84 |
| 4,306,340 | A | * | 12/1981 | Strudel et al. | 26/85 |
| 4,446,632 | A | * | 5/1984 | Dornier | 26/85 |
| 4,473,929 | A | * | 10/1984 | Green | 26/80 |
| 4,947,529 | A | * | 8/1990 | Werner et al. | 26/83 |
| 5,229,055 | A | * | 7/1993 | Wintermantel et al. | 264/167 |
| 5,594,978 | A | * | 1/1997 | Ferraro | 26/83 |
| 5,794,317 | A | * | 8/1998 | Aliison | 26/80 |
| 5,867,879 | A | * | 2/1999 | Ferraro et al. | 26/84 |
| 5,884,376 | A | * | 3/1999 | Bertoldo | 26/83 |

FOREIGN PATENT DOCUMENTS

| | | | |
|---|---|---|---|
| FR | 2592897 | * | 7/1987 |
| WO | WO9615303 | * | 5/1996 |

* cited by examiner

*Primary Examiner*—Amy B. Vanatta
(74) *Attorney, Agent, or Firm*—Biebel & French

(57) ABSTRACT

A stretcher for tubular knitwear fabric comprising: two arms (5, 6), driving wheels (7*a*, 7*b*), wheels (10, 11) with inclined axis (12), rings (8) mounted on the arms (5, 6) and magnets (17, 18) the magnets attracting the arms (5, 6), respectively, such that the rings (8) are offset from the inclined wheels (10, 11) and attracted against the driving wheels (7*a*, 7*b*).

9 Claims, 3 Drawing Sheets

1
2
3
4
5
6
7a
7b
8
9
10
13
14
15
16
17
17'
18
18'
19
20
A

STRETCHER FOR TUBULAR FABRIC WITH MAGNETIC ATTRACTION

The object of the present invention is a stretcher for tubular knitwear fabric, especially for application to calenders or other machines for the treatment of tubular fabric.

It is known that stretchers are used during the finishing step of tubular knitwear articles for stretching and spreading the tubular article in order to ease the finishing operations.

Thus in calendering, which is usually the last finishing operation, it is necessary to use a stretcher in order to achieve a uniform vaporisation and to adjust the width of the tubular article to the desired value.

Stretchers are known, such as, for example, the one protected by the european patent No. 0791092 assigned by the same Applicant of the present invention, in which the fabric is pressed between a ring or a shaped wheel and two inclined wheels, and consequently streaks or marks can be produced into the fabric. In this patent, the above embodiment is for keeping the stretcher arms in the right position by means of the pressure said inclined wheels exert against the shaped wheel, with the consequence of a pressure onto the fabric and thus of possibly damaging it.

Another stretcher of the prior art is protected by french patent No. 2.592.897, in which the vertical stretcher arms, besides being attracted outwards by a magnet so that they are kept in the right position, are also pushed by means of parallelograms that can be deformed by pressure, said parallelograms being interposed between the arms against the fabric advancing wheels.

This embodiment has the draw-back that said deformable parallelograms not only provide safety in case the magnets should not work properly, but also exert an excessive pressure onto the fabric against the driving wheels, thereby producing marks or streaks onto the fabric. This pressure is always acting, also when the sole attraction force of the magnet would be enough.

The purpose of the present invention is to obviate these draw-backs, with the advantage that between the stretcher arms there is no pressure member. Only the inclined wheels, which are constantly offset from the shaped wheels that are applied to said arms, because they are attracted by the magnets, might, in an emergency case, press the fabric against the shaped wheel, but only for a short time because upon adjustment of the magnet the inclined wheels are immediately removed from the shaped wheel that goes into contact with the driving wheel.

The features, advantages and the solution of the above mentioned technical problem at the basis of the invention will be evident from the following detailed description of a preferred, non exclusive embodiment of the subject stretcher which is illustrated in a merely illustrative, non limiting way in the accompanying figures, in which.

Figure 1:
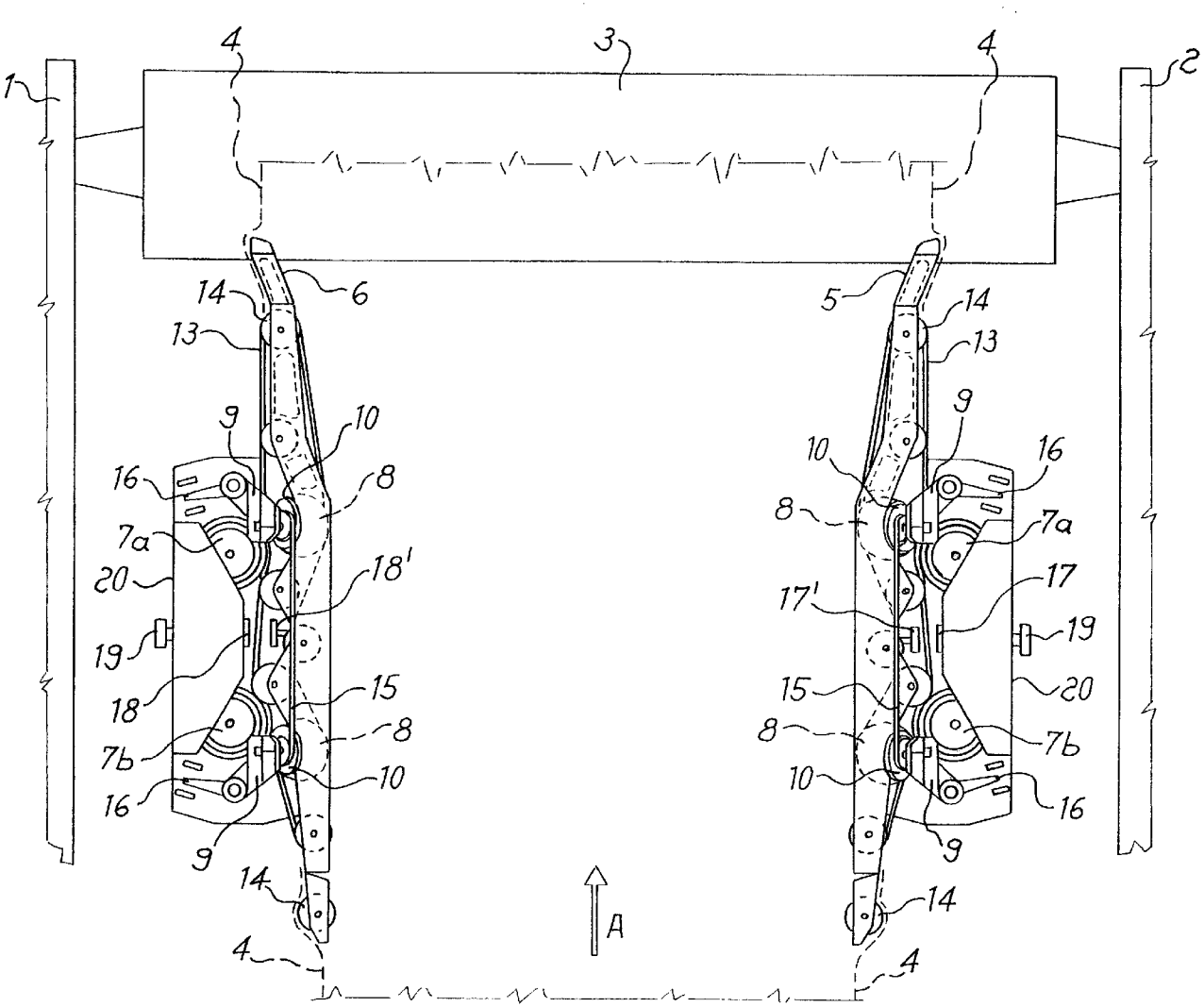
FIG. 1 shows a front view of the stretcher.

With reference to FIG. 1, the subject stretcher is comprised by stanchions 1 and 2 in which the several control and driving mechanisms are contained, that are not visible in the figure.

Said stanchions support the known vaporiser 3 within which the tubular fabric 4 is caused to slide after passing through the stretcher that is the object of the present invention.

Said stretcher comprises the stretcher arms 5 and 6 that in turn are supported by the support devices that are described hereinafter.

In the stanchions 1 and 2 motor means that are not shown in the figure transmit the motion to the upper driving wheels 7*a*, so that means that are not shown in the figure can cause the stretcher arms 5 and 6 to be displaced in opposite directions in order to possibly modify the width of the tubular fabric.

The upper driving wheels 7*a* are connected to the similar lower wheels 7*b* through means that are specified hereinbelow.

Figure 2:
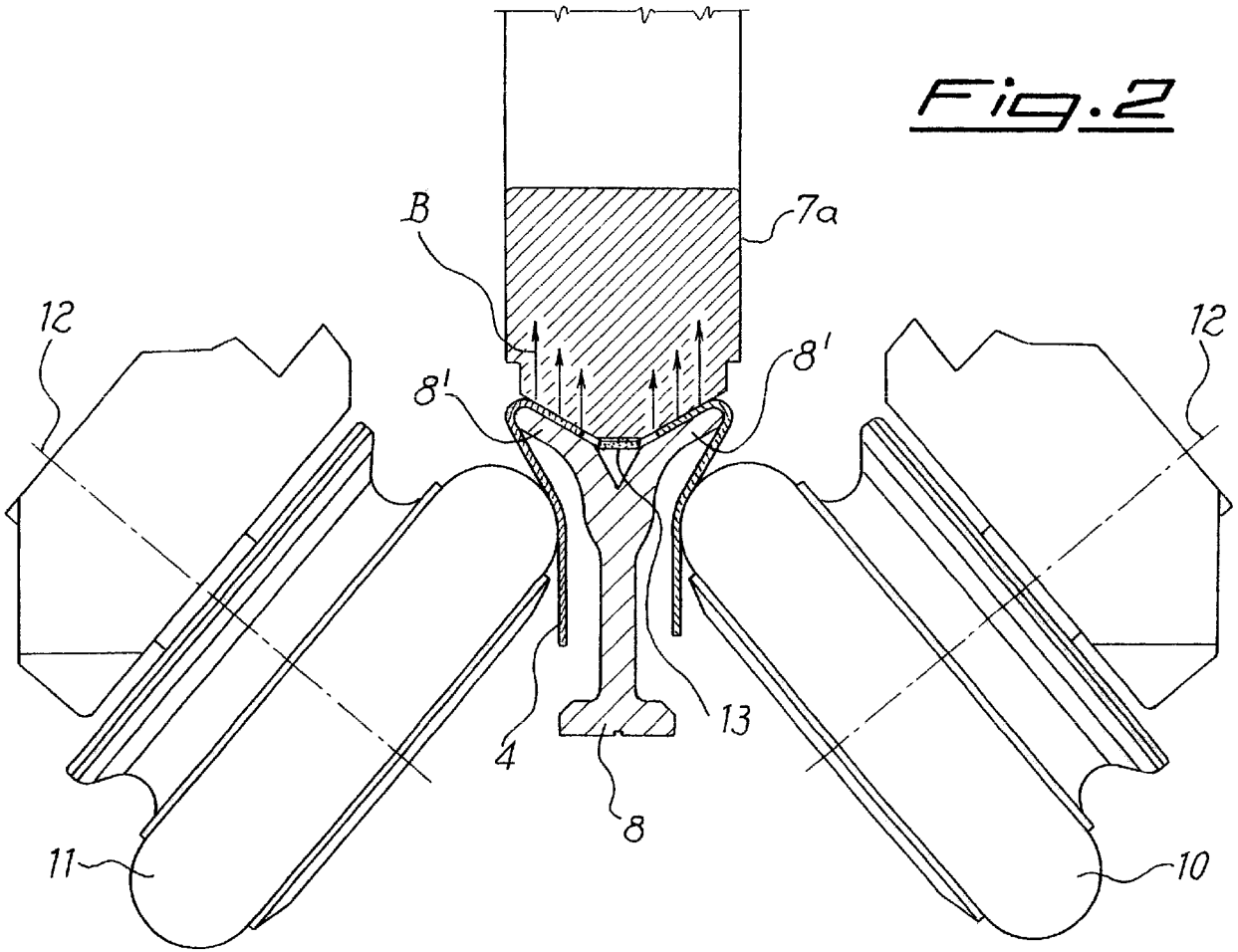
FIG. 2 shows an enlarged partial horizontal section view of the stretcher along line II—II of FIG. 1.

As can be clearly seen in FIGS. 1 and 2, the stretcher arms 5 and 6 carry wheels or rings 8 that are suitably shaped, said wheels or rings being arranged in front of the bulging portion the driving wheels 7*a* and 7*b* are provided with. These in turn have supports 9 that support the wheel pairs 10 and 11 with inclined axis 12.

Said wheels 10 and 11 with their peripheral parts are spaced apart from the circumferential outlines 8' of rings 8, this being due to the magnetic attraction force that acts onto the arms, as will be explained hereinafter.

The transportation of the tubular fabric 4 is carried out by means belts 13, said belts being wound around a set of pulleys 14 that are idly supported on the arms 5 and 6 along the contour of the driving wheels 7*a* and 7*b* and of the rings 8.

Figure 3:
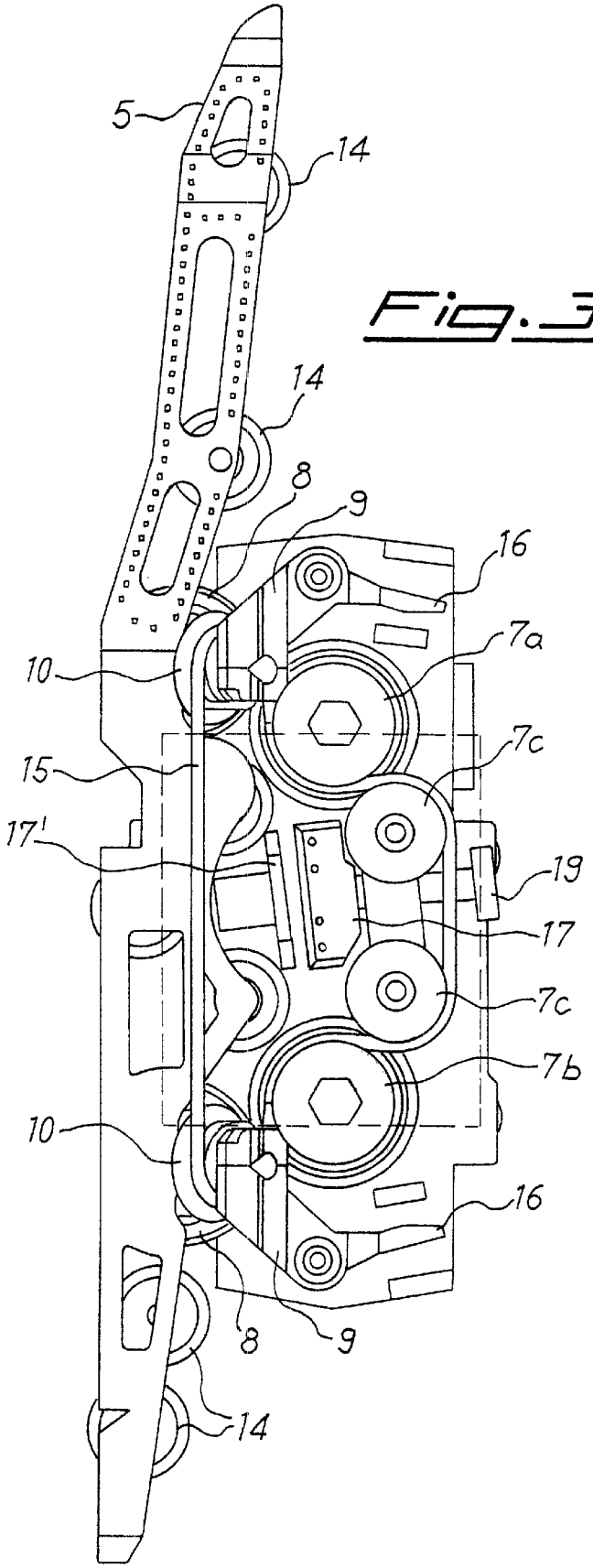
FIG. 3 shows an enlarged view of a portion of the stretcher.

As can be clearly seen in FIG. 3, both of the inclined wheels 10 are driven as they are connected to each other by means of an elastic belt 15 that is wound around the driving wheels 7*a* and 7*b* and the idle pulleys 7*c*.

Similarly, the inclined wheels 11 are driven because they are connected by means of elastic belts to the same driving wheels 7*a* and 7*b*.

Said driving has the advantage of markedly improving the transportation of the fabric.

In particular the supports 9 consist of fork brackets 16 for the adjustment of the working angles of arms 5 and 6.

According to the novel feature of the present invention, the wheels 10 and 11 are kept spaced apart from the rings 8 by means of magnets 17, 18 that attract the arms 5 and 6, respectively, outwards as shown by arrows B. Said rings 8 carried by arms 5 and 6 remain offset from the inclined wheels 10 and 11 and attracted against the driving wheels 7*a*, 7*b* by said magnets 17 and 18, and the fabric is advanced between the belts 13 and the driving wheels 7*a*, 7*b*.

Moreover there is to be noted that the attraction force of magnets 17 and 18 is adjustable, so that the offset between the rings 8 and the inclined wheels 10 and 11 is assured.

Said adjustment is obtained by means of a mechanism that causes the magnets 17 and 18 to be moved towards to or away from the arms 5 and 6, respectively. In fact the magnets 17 and 18 are connected to said mechanism, which is provided with an adjustment hand grip 19, said hand grip being suited to cause the magnets 17 and 18 to move towards to or away from the supports 17' and 18' that are fixedly connected to the bars 5 and 6.

Finally protections 20 are provided over the mechanisms that are provided with the adjustment hand grips 19.

The operation is as follows: the tubular fabric 4, which usually consists of several tubular pieces sewn together, is introduced from below, as can be seen in FIGS. 1 arid 2, between the wheels 10 and 11 and the ring 8, and between the ring 8 and the wheels 7*a* and 7*b* of each arm, thus being transported upwards in the direction of arrow A as the driving wheels 7*a*, 7*b*, that are coupled to the rings 8 and to the pulleys 14, rotate, said pulleys being mounted on the arms 5 and 6 that are kept in the right position and supported by the attraction force of the magnets 17 and 18.

When a greater width of the tubular fabric is to be obtained, the arms 5 and 6 are reciprocally displaced, until the maximum distance shown in the positions of FIG. 1 is achieved.

Moreover the stretcher can take all the positions from a minimum distance to a maximum one without the need to change the stretcher and thus without any machine stopping time for slipping the tubular fabric off the stretcher arms.

As has been specified above, with the present invention no damage is caused to the fabric, such as streaks or marks, because the fabric is never pressed between the ring 8 and the inclined wheels 10 and 11.

In an emergency case, should the magnets be in such a position as not to attract the arms 5 and 6, these would nevertheless remain in the right position because the rings 8 would lean with their circumferential outlines 8' against the wheels 10 and 11. However this situation would be a temporary one, and would return to normality upon correctly adjusting the position of the magnets 17 and 18 by means of the hand grips 19.

Modifications of a practical applicative nature will possibly be made in the construction details of the embodiment that will remain within the range of the invention, as claimed hereinbelow.

What is claimed is:

1. A stretcher for tubular knitwear fabric comprising: two arms (5, 6), driving wheels (7*a*, 7*b*), belts (13) mounted on the arms (5, 6), wheels (10, 11) with inclined axis (12) that are arranged in front of faces of rings (8), said rings being mounted on the arms (5, 6) in correspondence with the driving wheel (7*a*), characterised in that magnets (17, 18) are provided that act directly onto the arms (5, 6) attracting them outwards such that the rings (8) are attracted against the driving wheels (7*a*, 7*b*) and are offset from the inclined wheels (10, 11) with the fabric being advanced between the belts (13) and the driving wheels (7*a*, 7*b*).

2. A stretcher as claimed in claim 1, characterised in that the attraction force of the magnets (17, 18) is adjustable maintaining the offset of the rings (8) from the inclined wheels (10, 11).

3. A stretcher as claimed in claim 2, characterised in that said adjustment is obtained by means of mechanisms that cause the magnets (17, 18) to be moved towards or away from the arms (5, 6), respectively.

4. A stretcher as claimed in claim 3, characterised in that said mechanisms are provided with an adjustment hand grip connected to said magnets (17, 18) that are apt to be moved towards or away from supports (17', 18'), respectively fixed to the bars (5, 6).

5. A stretcher as claimed in claim 1, characterised in that said inclined wheels (10, 11) are driven by mechanical means (15) connected to the driving wheels (7*a*, 7*b*).

6. A stretcher as claimed in claim 3, characterised in that protections (20) are provided over said mechanisms.

7. A stretcher as claimed in claim 2, characterized in that said inclined wheels (10, 11) are driven by mechanical means (15) connected to; the driving wheels (7*a*, 7*b*).

8. A stretcher as claimed in claim 3, characterized in that said inclined wheels (10, 11) are driven by mechanical means (15) connected to the driving wheels (7*a*, 7*b*).

9. A stretcher as claimed in claim 4, characterized in that said inclined wheels (10, 11) are driven by mechanical means (15) connected to the driving wheels (7*a*, 7*b*).

* * * * *